US007652753B1

(12) United States Patent
Stephens et al.

(10) Patent No.: US 7,652,753 B1
(45) Date of Patent: Jan. 26, 2010

(54) LASER-DESIGNATED TARGET SIMULATOR AND METHOD OF TESTING A LASER-SEEKING MUNITION HEAD

(75) Inventors: Robert D. Stephens, Richardson, TX (US); Louis A. Hinson, Fruitvale, TX (US)

(73) Assignee: Stephens-Hinson & Associates, Richardson, TX (US)

( * ) Notice: Subject to any disclaimer, the term of this patent is extended or adjusted under 35 U.S.C. 154(b) by 1028 days.

(21) Appl. No.: 10/925,471

(22) Filed: Aug. 25, 2004

(51) Int. Cl.
*G01C 3/08* (2006.01)

(52) U.S. Cl. ..... 356/4.07; 356/152.1; 356/141.5; 250/203.1

(58) Field of Classification Search ..... 356/3.01–3.15, 356/4.01–4.1, 5.01–5.15, 6–22, 28, 28.5, 356/139.01–139.1
See application file for complete search history.

(56) References Cited

U.S. PATENT DOCUMENTS

| | | | | |
|---|---|---|---|---|
| 3,857,042 | A * | 12/1974 | LaGrange et al. | 250/495.1 |
| 4,860,016 | A * | 8/1989 | Westphal et al. | 342/169 |
| 5,485,263 | A * | 1/1996 | Bjorner et al. | 356/4.01 |
| 6,531,691 | B1 * | 3/2003 | Pruet et al. | 250/216 |
| 2003/0043058 | A1 * | 3/2003 | Jamieson et al. | 340/961 |

* cited by examiner

*Primary Examiner*—Thomas H Tarcza
*Assistant Examiner*—Luke D Ratcliffe

(57) ABSTRACT

A laser-designated target simulator for testing laser-guided munitions and in particular the laser-seeking heads thereof. In one embodiment, the simulator includes: (1) a laser light source configured to provide laser light, (2) a waveguide configured to receive the laser light via an end thereof, (3) a baffle structure having a plurality of cavities associated therewith and (4) an actuator coupled to the laser light source and the end and configured to establish a distance therebetween, an intensity of the laser light entering the end being a function of the distance and a number of cavities interposing the laser light source and the end.

18 Claims, 5 Drawing Sheets

NOTE: VIEW SHOWN IS FOR SINGLE CHANNEL SYSTEM. NUMBER OF CHANNELS MAY BE EXPANDED AS REQUIRED TO SUPPORT SYSTEM DESIGN.

LASER-DESIGNATED TARGET SIMULATOR AND METHOD OF TESTING A LASER-SEEKING MUNITION HEAD

TECHNICAL FIELD OF THE INVENTION

The present invention is directed, in general, to laser-guided munitions and, more specifically, to a laser-designated target simulator and a method of testing a laser-seeking munition head.

BACKGROUND OF THE INVENTION

Although they have been in use since Vietnam, precision, laser-guided munitions (bombs, artillery shells and rockets) made their most public debut in the Gulf War of the early 1990s. Widely disseminated images of laser-guided munitions entering buildings through selected vent shafts or hitting bridges at specific structurally critical points gave the impression not only that a relatively small number of "smart" munitions could perform the same jobs that previously required carpet bombing or nuclear weaponry but also that collateral damage, and particularly civilian casualties, could be held to a minimum. The latest generation of laser-guided munitions is even more accurate and powerful than those used in the Gulf War and certainly represents the dominant trend in high precision aerial attack.

A laser-guided munition functions by homing in on a target illuminated (or "designated") by a reflected spot of laser light. The laser light is modulated to distinguish it from other laser sources that may be nearby. A laser-seeking head mounted on the munition contains optical sensors that detect the reflected laser light. The laser-seeking head typically first acquires and verifies the reflected laser light at a distance of several miles. Thereafter, the head moves control surfaces on the munition to maintain the spot of reflected light within its "cross-hair." As the munition closes on the target, the intensity of the reflected laser light amplifies significantly (roughly as a function of the square of the distance separating the target and the head).

Laser-guided munitions work best under ideal atmospheric conditions. Unfortunately, battlegrounds tend away from the ideal. Clouds, smoke, waves of hot air and intervening objects distort, obscure and attenuate the reflected laser light, making laser-designated target acquisition, verification and successful closure difficult. The consequence of failing to close to a target is either an unfulfilled military objective or collateral damage, both of which are unacceptable.

Testing of laser-seeking heads is therefore vital. Testing occurs in three phases. New designs of laser-seeking heads or new components for existing laser-seeking heads are advantageously design-tested under a wide variety of conditions to ensure that they will perform as designed. Newly manufactured laser-seeking heads are advantageously acceptance-tested to ensure that they have been correctly manufactured and calibrated. Laser-seeking heads that have been field-deployed are field-tested to ensure that they remain in good working order and proper calibration.

The best way to test laser-seeking heads is to provide to a laser-seeking head under test a simulation of the laser light that would be reflected back from a fictitious target. However, laser-designated target simulators do not have the luxury of replicating the actual distances involved. Instead, they are forced to use expensive laser light sources to provide the full range of, and proper increases in, light intensity that simulation requires. As a result, conventional target simulators are expensive, bulky and require extensive and time-consuming calibration to ensure proper operation.

What is needed in the art is a better laser-designated target simulator and a method of testing laser-seeking heads. More specifically, what is needed in the art is a laser-designated target simulator that does not require expensive laser light sources to provide the full range of, and proper increases in, light intensity.

SUMMARY OF THE INVENTION

To address the above-discussed deficiencies of the prior art, one aspect of the present invention provides a laser-designated target simulator for testing laser-guided munitions. In one embodiment, the simulator includes: (1) a laser light source configured to provide laser light, (2) a waveguide configured to receive the laser light via an end thereof, (3) a baffle structure having a plurality of cavities associated therewith and (4) an actuator coupled to the laser light source and the end and configured to establish a distance therebetween, an intensity of the laser light entering the end being a function of the distance and a number of cavities interposing the laser light source and the end.

In another aspect, the present invention provides a method of testing a laser-seeking munition head. In one embodiment, the method includes: (1) providing laser light from a laser light source, (2) receiving the laser light into an end of a waveguide, a baffle structure having a plurality of cavities associated therewith interposing the laser light source and the end and (3) establishing a distance between the laser light source and the end, an intensity of the laser light entering the end being a function of the distance and a number of cavities interposing the laser light source and the end.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 4:
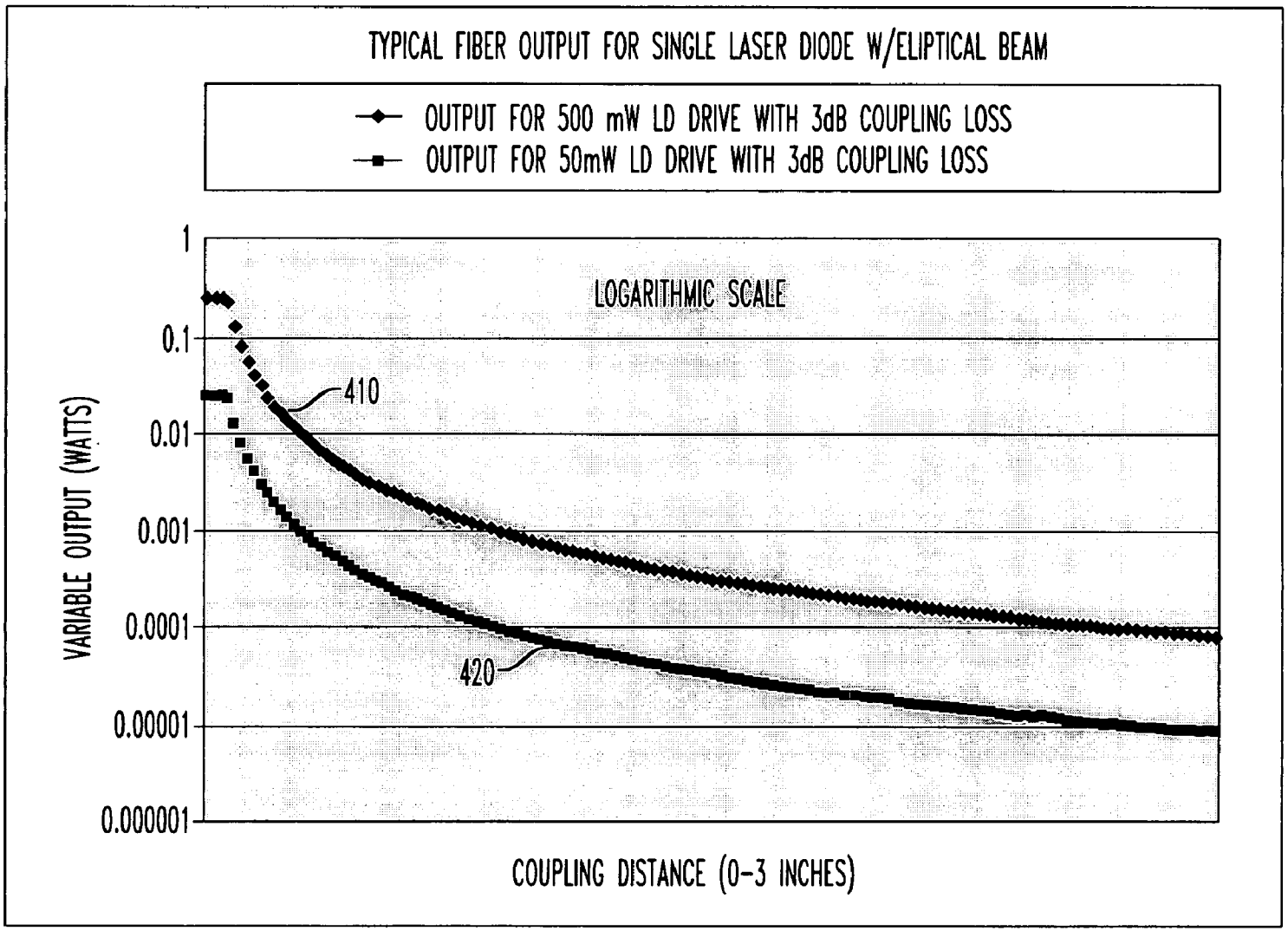
FIG. 4 illustrates a graph along a logarithmic scale of typical waveguide optic output for a single laser diode with an elliptical beam.

The functional concept underlying the simulator is based on the characteristics of a typical LED or LD output beam as it diverges from the emitting surface. (See FIG. 4, illustrating a graph along a logarithmic scale of typical waveguide optic output for a single laser diode with an elliptical beam.) In general, the beam can be circular or elliptical as is typical for LEDs and LDs respectively. To achieve variable power, two functions are independently controlled that effectively simulate a pseudo "R-Squared" dynamic range function thus emulating the signal strength available to a generic laser guidance system in flight. These two functions are:

- a fixed collecting area (such as a precisely sized, i.e., 500 micron fiber optics cable) at variable distances; and
- a LED or LD (of appropriate emission wavelength and power for the selected application) driven with a variable voltage or current drive source.

The illustrated embodiment of the simulator has four major parts: (1) one or more LED or LD laser light sources at a required wavelength, (2) a control system for the timing, firing and power output of the laser light source(s), (3) a baffle structure that serves to reduce internal reflections and recombinations of laser light, thus emulating the transmission characteristics of free space, and (4) a waveguide (e.g., fiber optic) capture and transmission capability for the laser energy.

The laser light source(s) are contained in a package which includes the laser emitting material (LD or LED, a thermistor to measure temperature of the laser light source, and a thermoelectric cooler/heater to stabilize the emissions at the desired wavelength. The LED or LD is mounted on an interface plate, which provides mechanical location and retention for proper alignment with the waveguide.

The control system provides the required voltages and timing pulses to cause the laser light source to emit the desired energy at the proper pulse width and pulse repetition rate. The voltages and timing pulses are provided through external power sources and software controlled inputs from the host computer.

The baffle structure has a series of baffle plates, with cavities in the face which minimize reflections in the propagation path of the laser energy. As the laser energy is emitted in a diverging pattern, the emitted pulse energy is spread in the attenuator cavities. A precision positioning baffle may be used to align the end of the waveguide properly at close distances to the laser light source. Only a portion of the energy is passed through the baffles to the end of the waveguide based on its position at any given time. In the illustrated embodiment, the position of the end is controlled by a host computer interfacing with a stepper motor drive controller, using the stepper motor drive screw to position the end.

The waveguide captures a portion of the laser energy for transmission to the final use point. The amount of the energy captured is a result of the emission angle of the laser light source and the proximity and alignment of the face of the end to the laser light source. The laser energy gathered is passed through the waveguide to the point of use with minimum loss of signal strength.

As stated above the variable power output is achieved by controlling two variables: (1) LED or LD drive current and (2) the distance between the laser light source and the end of the waveguide.

By controlling the combination of laser light source drive current and waveguide end distance from the laser light source, a power output from the waveguide is achieved from zero power (no signal) to a level consistent with the laser-seeking head's sensitivity to a power level near saturation, thus emulating a general dynamic range flight profile. In cases where high power is required to reach system saturation, multiple laser light sources with individual fiber optics cables can be used to achieve greater dynamic range as required.

Figure 1:
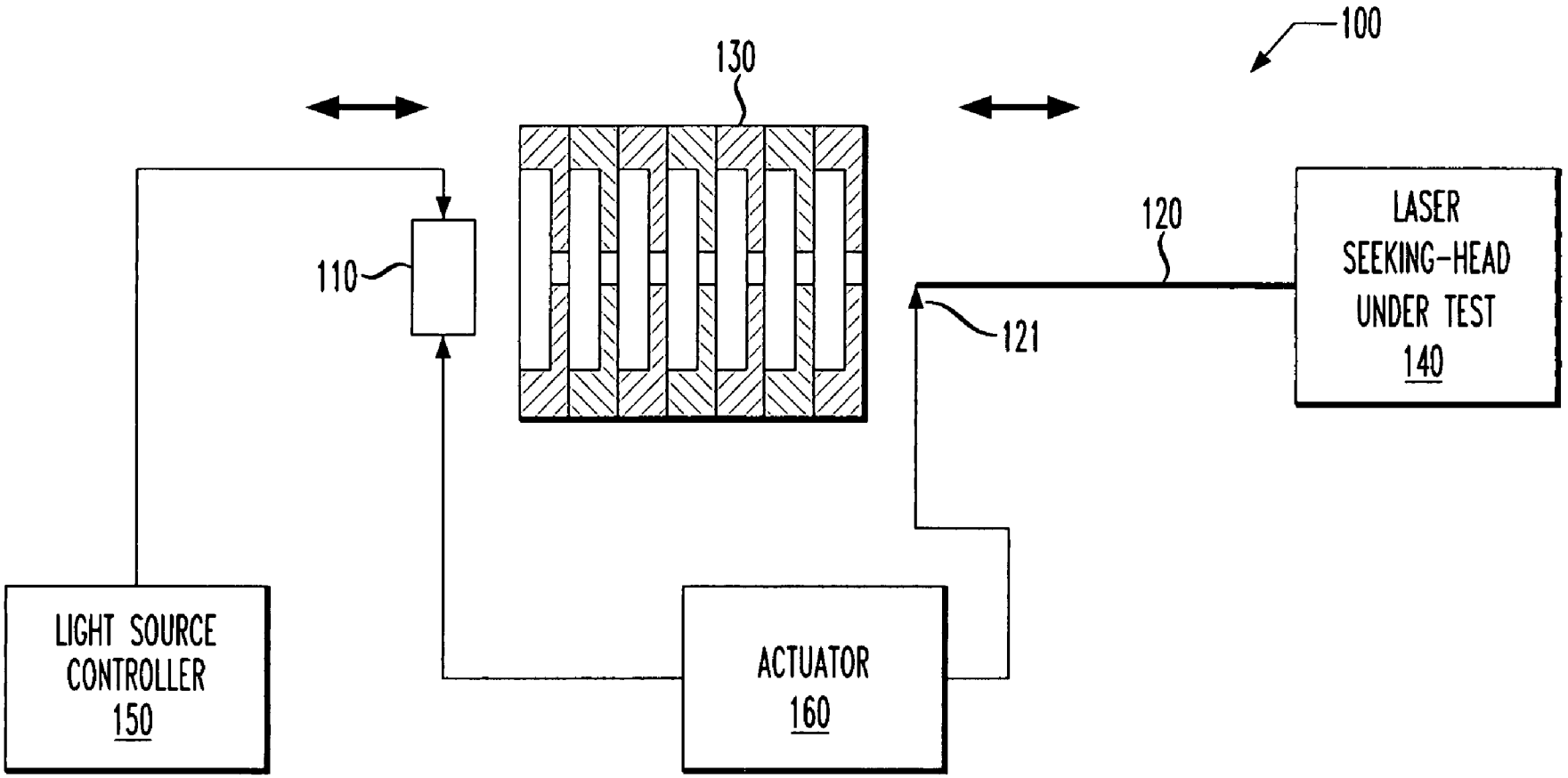
FIG. 1 illustrates a schematic diagram of one embodiment of a laser-designated target simulator for testing laser-guided munitions constructed according to the principles of the present invention.

Referring initially to FIG. 1, illustrated is a schematic diagram of one embodiment of a laser-designated target simulator, generally designated 100, for testing laser-guided munitions constructed according to the principles of the present invention. The simulator 100 includes a laser light source 110. The laser light source 110 is configured to provide laser light. In the illustrated embodiment, the laser light source is a light-emitting diode (LED) or a laser diode (LD). However, those skilled in the pertinent art understand that any source capable of emitting coherent light falls within the broad scope of the present invention.

The simulator 100 further includes a waveguide 120. The waveguide 120 is configured to receive the laser light via an end 121 thereof. In the illustrated embodiment, the waveguide 120 is an optical fiber.

A baffle structure 130 interposes the laser light source 110 and the end 121. The illustrated embodiment of the baffle structure 130 has a plurality of baffle plates (not separately referenced). In fact, FIG. 1 shows seven baffle plates. Each baffle plate has an associated cavity and an associated aperture (again, not separately referenced). The cavities attenuate the laser light emanating from the laser light source 110 in a manner to be described. The apertures provide a direct path from the laser light source 110 to the end 121 for laser light. In the illustrated embodiment, the apertures further allow the end 121 of the waveguide 120 to enter the baffle structure 130 and approach the laser light source 110.

So that the simulator 100 may be used in testing, the waveguide 120 terminates at its distal end in a laser-seeking head under test 140. As described above, the laser-seeking head under test 140 contains one or more optical sensors designed to receive the laser light transmitted through the waveguide 130, interpret it as laser light reflected from a distant target and acquire and follow it.

A light source controller 150 is illustrated as being coupled to the laser light source 110. The light source controller modulates the laser light source 110 to cause it to be identified by the laser-seeking head under test 140 and further to attenuate its output to make it seem distant. In the illustrated embodiment, the light source controller 150 varies the voltage of drive current provided to the laser light source 110 and further pulse-width modulates the laser light source 110 to vary the intensity of its output.

An actuator 160 is coupled to the laser light source 110 and the end 121 of the waveguide 120. The actuator 160 is configured to establish a distance between the laser light source and the end 121. In the illustrated embodiment, the actuator is a linear actuator, includes a stepper motor and moves the end 121 (signified by a double-headed arrow over the end 121); the laser light source 110 remains still. In alternative embodiments, the actuator 160 may be an actuator of any type, including a rotary actuator and may move the laser light source 110 instead of the end 121, or both the laser light source 110 and the end 121.

In the illustrated embodiment, the actuator 160 drives the end 121 from the right to the left, as FIG. 1 is oriented. The end 121 enters the baffle structure 130 and passes sequentially through its various apertures. As the end 121 passes through the apertures, the intensity of the laser light entering the end 121 grows (indicating to the laser-seeking head under test 140 that the target is approaching). The intensity of the laser light grows as a function of the distance and a number of cavities interposing the laser light source 110 and the end 121. In the illustrated embodiment, the intensity of the laser light grows further as the light source controller 150 increases the output of the laser light source 110.

Figure 2:
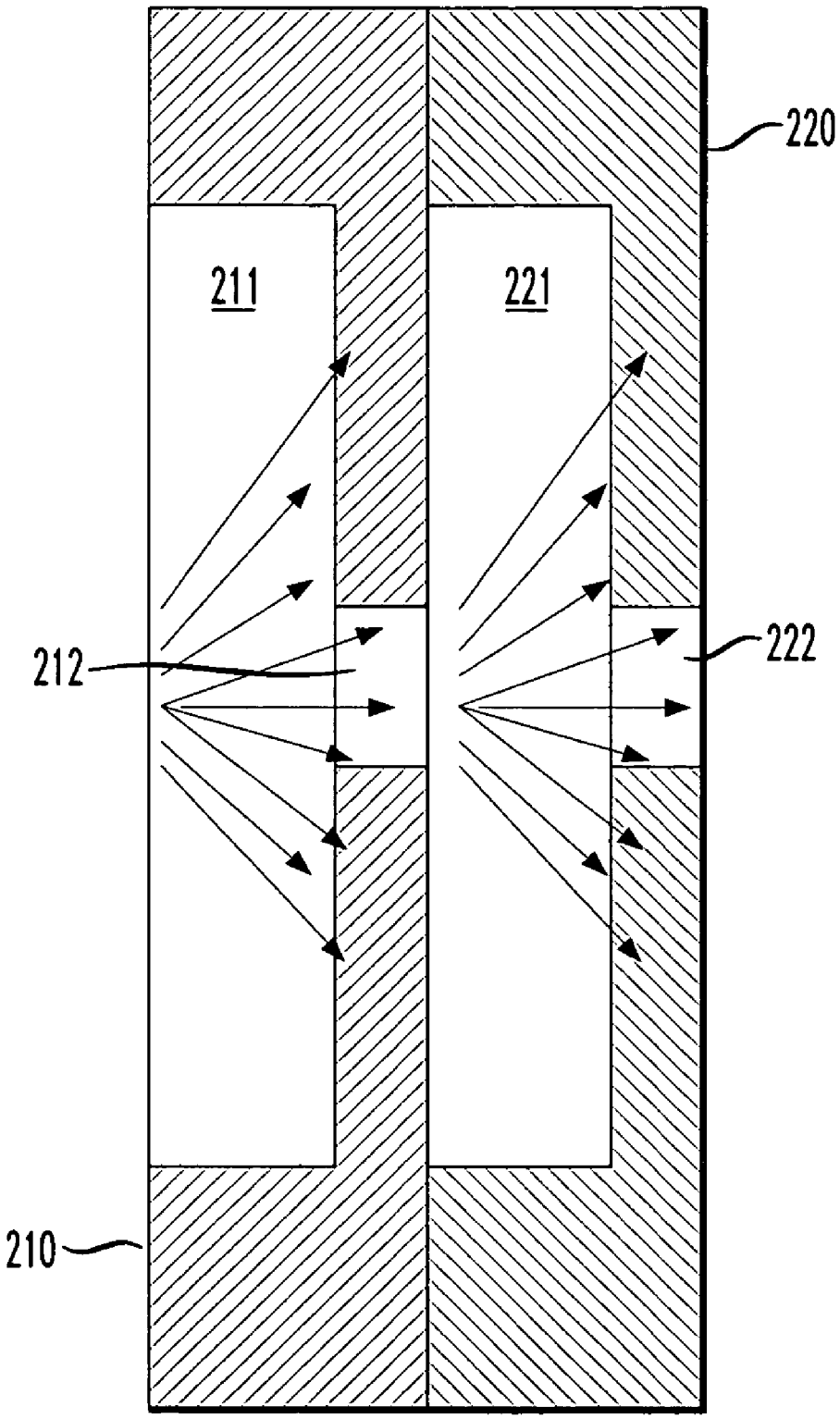
FIG. 2 illustrates a more detailed diagram of baffle plates located in the baffle structure of FIG. 1.

Turning now to FIG. 2, illustrated is a more detailed diagram of baffle plates located in the baffle structure 130 of FIG. 1. FIG. 2 shows a first baffle plate 210 and a second baffle plate 220. The first baffle plate 210 has a first cavity 211 and a first aperture 212 associated therewith. The second baffle plate 220 has a second cavity 221 and a second aperture 222 associated therewith.

In the illustrated embodiment, the first cavity 211 and the first aperture 212 are annular and coaxial with respect to one another. The first aperture 212 passes completely through the first baffle plate 210, allowing laser light to pass through the first baffle plate 210 and, in the illustrated embodiment, further allowing the end 121 of the waveguide 120 (both of FIG. 1) to pass through the first baffle plate 210. The first cavity 211 serves to absorb or otherwise dissipate laser light emanating from the aperture of a neighboring baffle plate (not shown). Accordingly, the first cavity 211 may be coated with a light-absorbing material of any type.

Likewise, in the illustrated embodiment, the second cavity 221 and the second aperture 222 are annular and coaxial with respect to one another. The second aperture 222 passes completely through the second baffle plate 220, allowing laser light to pass through the second baffle plate 220 and, in the illustrated embodiment, further allowing the end 121 of the waveguide 120 (both of FIG. 1) to pass through the second baffle plate 220. The second cavity 221 is coaxial with the first aperture 212 and serves to absorb or otherwise dissipate laser light emanating from the first aperture 212. The second cavity 221 may also be coated with a light-absorbing material of any conventional type.

FIG. 2 illustrates a plurality of diverging arrows intended to represent rays of laser light as they pass through the first and second cavities 211, 221 and the first and second apertures 212, 222. It is apparent that significant fractions of the laser light passing through the first aperture 212 fail to pass into the second aperture 222. The effect is compounded over a number of adjoining baffle plates. Thus, it is apparent that a baffle structure of the type described herein has the ability to simulate the attenuation that would occur to laser light over a substantial distance. Decreasing the distance between the laser light source and the end of the waveguide (and thereby traversing the baffle structure) has the effect of closing that distance and thereby simulating the approach of a munition to an illuminated target.

Figure 3:
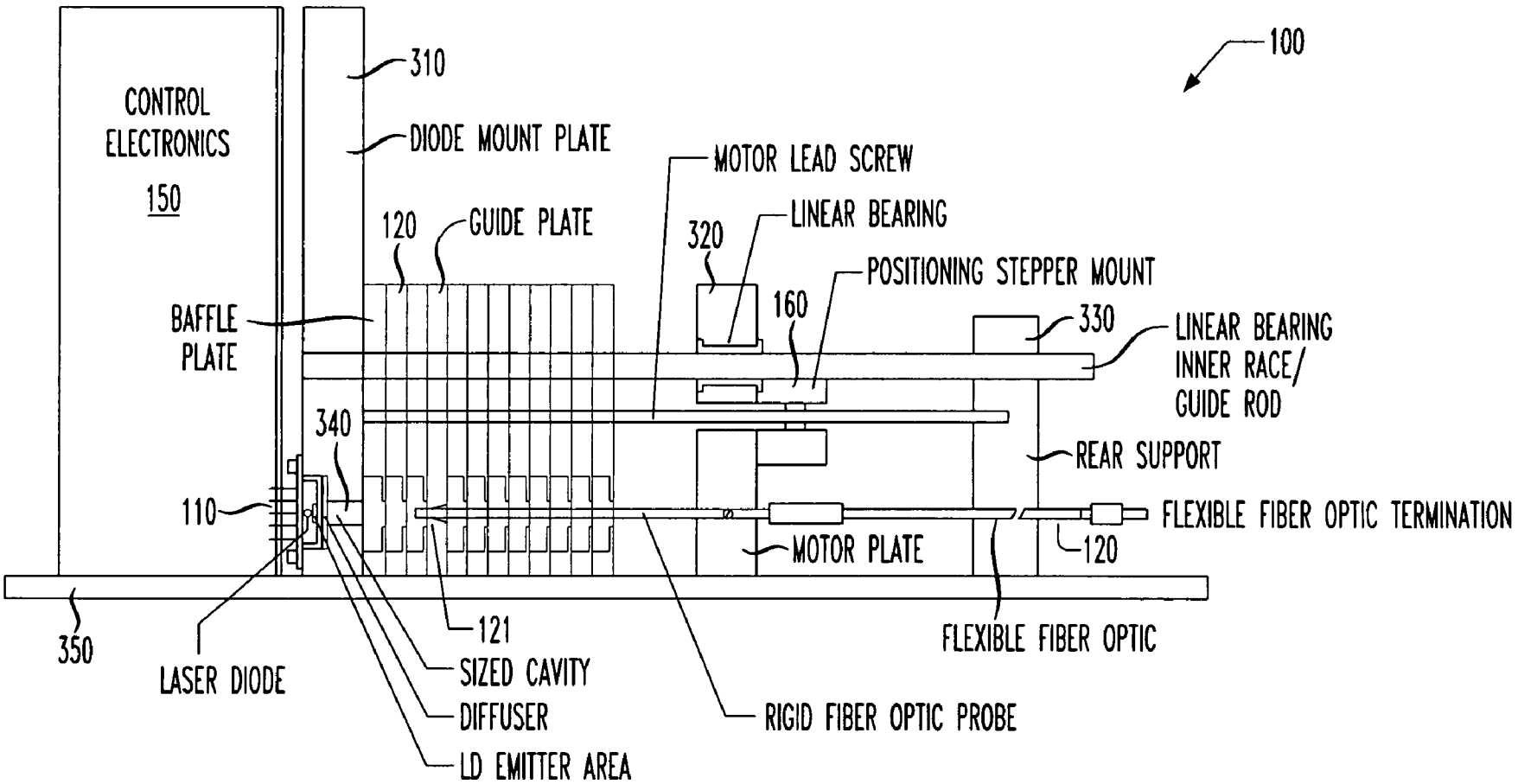
FIG. 3 illustrates an elevational view of a more detailed diagram of one embodiment of a laser-designated target simulator for testing laser-guided munitions constructed according to the principles of the present invention.

Turning now to FIG. 3, illustrated is an elevational view of a more detailed diagram of one embodiment of a laser-designated target simulator for testing laser-guided munitions constructed according t the principles of the present invention. Like elements to those in FIG. 1 are assigned like reference numerals.

In addition, FIG. 3 shows a base 350 on which the simulator is mounted. A laser light source mount plate 310 extends upwardly from the base 350, providing a solid mount for the laser light source 110. A diffuser 340 diffuses the laser light emanating from the laser light source 110. A linear bearing 320 and a rear support 330 provide support for the actuator 160 (e.g., stepper motor).

The laser light source 110 in the embodiment of FIG. 3 is a laser diode. The laser diode has a typical output slope efficiency of between about 0.6 and about 0.9 watts/ampere, a typical threshold drive current of between about 50 and about 100 mA and a typical maximum drive current of between about 0.5 and about 1.0 ampere. The laser diode's operational temperature is individually stabilized and controlled by driving an integral Peltier module (heater/cooler) with an integrated temperature controller (ITC). This yields a stable operational wavelength and output power over the temperature control range of the ITC. The end result of the generation and control of the laser pulses provides, in a simulator using laser diodes, the capability to generate and control laser energy from extremely low levels to levels near the source output.

Variable coupling is accomplished by controlling the position (distance from the emitting surface) of an extremely small optical aperture such as a 500 micron fiber optics cable.

Figure 5:
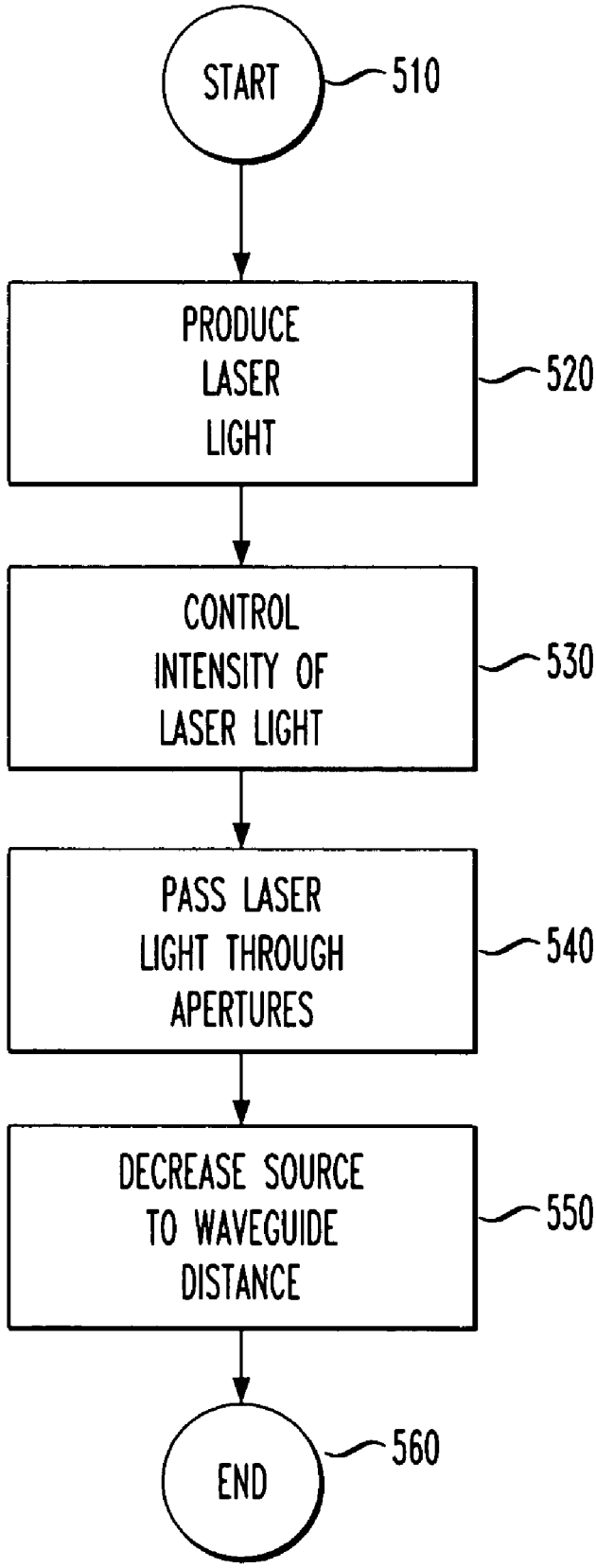
FIG. 5 illustrates a flow diagram of one embodiment of a method of testing a laser-seeking munition head carried out according to the principles of the present invention.

Turning now to FIG. 5, illustrated is a flow diagram of one embodiment of a method of testing a laser-seeking munition head carried out according to the principles of the present invention. The method begins in a start step 510 wherein it is desired to test a laser-seeking munition head. In a step 520, laser light is provided from a laser light source. In a step 530, the laser light is controlled in its intensity by controlling the output of the laser light source or switching an optical switch proximate the laser light source. In a step 540, the laser light passes through various apertures in various baffle plates of a baffle structure until it is received into an end of a waveguide.

In a step 550, the distance between the laser light source and the end of the waveguide is decreased. In the illustrated embodiment of the method, the end of the waveguide actually enters the baffle structure and passes through at least some of its apertures. As it does, the number of cavities interposing the laser light source and the end decreases. The intensity of the laser light entering the end increases. This simulates the light a laser-seeking head would see as it approaches a laser-illuminated target, allowing the head to be tested. The method ends in an end step 560.

Although the present invention has been described in detail, those skilled in the art should understand that they can make various changes, substitutions and alterations herein without departing from the spirit and scope of the invention in its broadest form.

What is claimed is:

1. A laser-designated target simulator, comprising:

a laser light source configured to provide laser light;

a waveguide configured to receive said laser light via an end thereof;

a baffle structure having a plurality of cavities associated therewith; and an actuator coupled to said laser light source and said end and configured to establish a distance therebetween, an intensity of said laser light entering said end being a function of said distance and a number of cavities interposing said laser light source and said end, wherein said actuator moves said end to establish said distance.

2. The simulator as recited in claim 1 wherein said actuator is a linear actuator.

3. The simulator as recited in claim 1 wherein said actuator comprises a stepper motor.

4. The simulator as recited in claim 1 wherein said laser light source is selected from the group consisting of:

a light-emitting diode, and a laser diode.

5. The simulator as recited in claim 1 wherein said baffle structure comprises a plurality of baffle plates corresponding to said plurality of cavities, said plurality of baffle plates having a plurality of apertures corresponding thereto.

6. The simulator as recited in claim 1 wherein said actuator establishes said distance by moving said end through at least one aperture in said baffle structure.

7. The simulator as recited in claim 1 further comprising a light source controller coupled to said laser light source and configured to control an intensity of said laser light provided thereby.

8. The simulator as recited in claim 1 further comprising an optical switch interposing said laser light source and said end.

9. The simulator as recited in claim 8 further comprising a light source controller coupled to said switch and configured to control said switch to interrupt said laser light.

10. A method of testing a laser-seeking munition head, comprising:

providing laser light from a laser light source;

receiving said laser light into an end of a waveguide, a baffle structure having a plurality of cavities associated therewith interposing said laser light source and said end; and establishing a distance between said laser light source and said end, an intensity of said laser light entering said end being a function of said distance and a number of cavities interposing said laser light source and said end, wherein said establishing comprises moving said end.

11. The method as recited in claim 10 wherein said establishing is carried out by a linear actuator.

12. The method as recited in claim 10 wherein said establishing is carried out by a stepper motor.

13. The method as recited in claim 10 wherein said laser light source is selected from the group consisting of:

a light-emitting diode, and a laser diode.

14. The method as recited in claim 10 wherein said baffle structure comprises a plurality of baffle plates corresponding to said plurality of cavities, said plurality of baffle plates having a plurality of apertures corresponding thereto.

15. The method as recited in claim 10 wherein said establishing comprises moving said end through at least one aperture in said baffle structure.

16. The method as recited in claim 10 further comprising controlling an intensity of said laser light provided by said laser light source.

17. The method as recited in claim 10 further comprising providing an optical switch between said laser light source and said end.

18. The method as recited in claim 17 further comprising controlling said switch to interrupt said laser light.

* * * * *